United States Patent [19]

Huang

[11] Patent Number: 4,950,519

[45] Date of Patent: Aug. 21, 1990

[54] INTERCONNECTABLE ARTIFICIAL LAWN SECTIONS

[76] Inventor: Dennin Huang, 2F, No. 1, Lane 9, Ningpo E. St., Taipei, Taiwan

[21] Appl. No.: 341,797

[22] Filed: Apr. 21, 1989

[51] Int. Cl.[5] ..... B32B 3/10

[52] U.S. Cl. ..... 428/44; 428/53; 428/17; 52/180

[58] Field of Search ..... 428/44, 52, 53, 17; 404/36, 41; 52/177, 180

[56] References Cited

U.S. PATENT DOCUMENTS 3,390,044 6/1968 Malakoff ..... 428/53 X 3,616,104 10/1971 Kuzmick ..... 428/53 X

*Primary Examiner*—Alexander S. Thomas

*Attorney, Agent, or Firm*—Bucknam and Archer

[57] ABSTRACT

An artificial lawn section capable of interconnection with similar sections comprising a base member (1) having first and second pairs of adjacent sides, said first pair of adjacent sides having a plurality of connecting members (11) projecting outwardly therefrom, each connecting member having an upstanding projection member (111) formed thereon, the base member (1) having a plurality of throughbores (121,121'; 221,221') formed therein, said throughbores being of two different sizes and being arranged in rows wherein each row consists of bores of the same size, clusters of artificial grass (12,12') insertable from above into, and retainable in, said throughbores, wherein the row of throughbores adjacent the two sides forming the second pair of adjacent sides consists of the larger sized bores (121;211) which are each capable of receiving an upstanding projection member (111) formed on a second section (2) pushed upwardly thereinto and a plurality of projecting cushioning members (13;23) projecting from the underside of the base member (1).

6 Claims, 1 Drawing Sheet

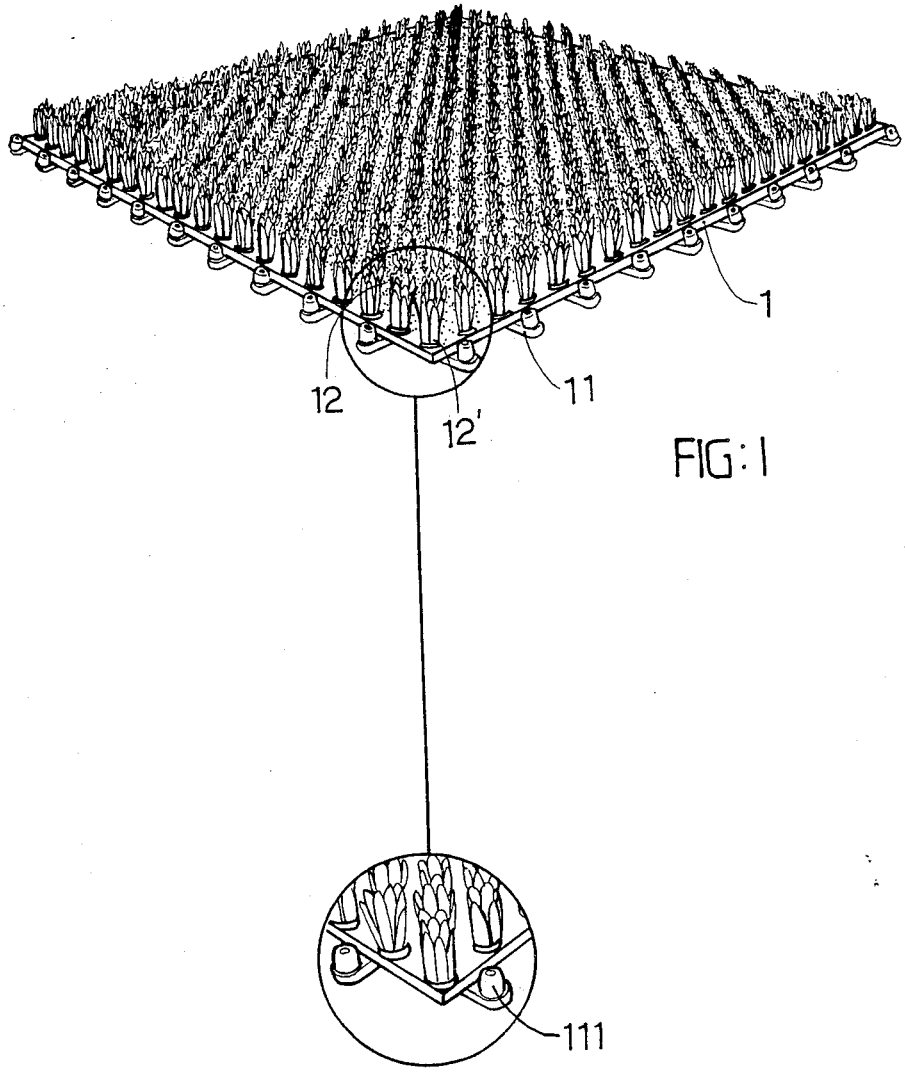
FIG: 1
FIG: 1-1
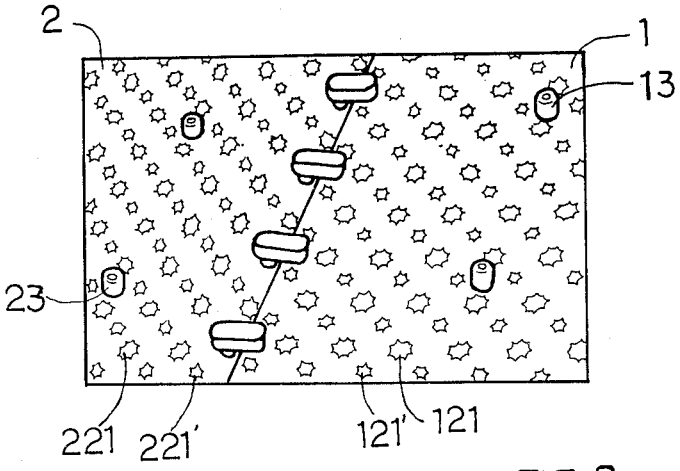
FIG: 2

INTERCONNECTABLE ARTIFICIAL LAWN SECTIONS

The present invention relates to an artificial lawn section and, more particularly, to an artificial lawn section which is interconnectable to other identical sections so as to produce a lawn of a desired size.

As the world becomes more industrialised, increasing urbanisation has become inevitable. The migration of people into cities means that the number of buildings and other constructions are ever increasing, whilst the number and size of open spaces are decreasing. Accordingly, open green spaces are highly prized by city dwellers.

Moreover, such increasing urbanisation means that there is a deficiency of space for leisure activities. For example, in some schools and kindergartens, there is no suitable outdoor area for some activities and hence these activities must be carried out indoors, if at all. Even if an outdoor area is available, it is often not possible to provide a natural grass area and, accordingly, artificial grass surfaces have become popular.

Conventional artificial lawns are produced from a plurality of identical sections. Each section comprises a base portion formed from transversely and longitudinal frame members with the spaces thus defined having clusters of artificial grass inserted therein. Each section has connecting members arranged along each of two adjacent sides and circular bores formed in projection members arranged along the edges of the other two adjacent sides for connection of the section to other identical sections so as to form an artificial lawn. However, these known artificial grass sections have the certain disadvantages.

Firstly, it is difficult to match the sections of artificial grass to form an artificial lawn. Alternatively or additionally, the artificial lawn can not be smoothly laid or rolled up. More particularly, the fitting of the connecting members into the circular bores is time-consuming and labour-intensive.

Secondly, the connecting members and the projecting members in which the bores are formed both protrude beyond the periphery of the section. Accordingly, above each connection, no clusters of artificial grass can be arranged thereon. Once the artificial lawn has been laid, therefore, a gap exists between each adjoining pair of sections which is not aesthetically pleasing.

Thirdly, the base member of each artificial grass section is made from a hard plastic material, as are the clusters of artificial grass. The artificial lawn thus produced is, therefore, not soft on the feet of a user.

Fourthly, since the sections are made of hard plastics material, it is difficult to lay the artificial lawn over uneven ground.

According to the present invention, there is provided an artificial lawn section capable of interconnection with similar sections comprising a base member having first and second pairs of adjacent sides, said said fist pair of adjacent sides having a plurality of connecting members projecting outwardly therefrom, each connecting member having an upstanding projection member formed thereon, the base member having a plurality of throughbores formed therein, said throughbores being of two different sizes and being arranged in rows wherein each row consists of bores of the same sizes, a plurality of clusters of artificial grass replaceably insertable from above into, and non-rotably retainable in, said throughbores, wherein the row of throughbores adjacent the two sides forming the second pair of adjacent sides consists of the larger sized bores which are each capable of receiving an upstanding projection member formed on a second section pushed upwardly thereinto and a plurality of projecting cushioning members projecting from the underside of the base member.

The invention will be further described, by way of example, with reference to the accompanying drawings, in which:

FIG. 1 is a perspective view of a section of artificial grass in accordance with the present invention.

FIG. 1—1 is a view similar to FIG. 1 but on a scale relative thereto of the detail ringed in FIG. 1; and FIG. 2 shows a perspective view from below of the interconnection of two sections of the type shown in FIG. 1.

In FIG. 1, there is shown a substantially square section of artificial grass. The section comprises a base 1 made of soft polyvinyl chloride material. Projecting outwardly from the underside of two adjacent sides of the square are connecting members 11 which have upstanding projections 111 formed thereon. The base 1 has throughbores 121 and 121' formed therein. From above, different sized clusters of artificial grass, 12 and 12' are inserted into the throughbores 121 and 121'. It will be noted that each bore 121 has a generally octagonal shape and each bore 121' has a generally hexagonal shape, the bores 121 being larger in size than the bores 121', to facilitate the drainage of rain or other water. Each section of grass has a plurality of downwardly projecting cushioning members 13, 23 formed on its underside to maintain the section slightly elevated above the ground for easy drainage of water. The artificial lawn thus may be always kept in a dry and clean condition.

When surfacing an area with the sections of artificial lawn in accordance with the present invention, it is usually necessary to interconnect the sections. This is effected as shown in FIG. 2. The two sections are aligned so that one of the two sides carrying connecting members of the first section is aligned with a side not carrying connecting members of an identical section. The projections 111 are then inserted, from below, into the octagonal bores 221 of the second section. This procedure can be followed as many times as desired. It should be pointed out that the arrangement of the clusters and associated throughbores is not random. Thus, in each section, the rows adjacent the edges which do not carry connecting members 11 consist exclusively of clusters 12 and throughbores 121. In use, an artificial lawn produced from sections in accordance with the present invention can provide the following advantages over known artificial lawn arrangements.

(1) The connection and disconnection of the sections to and from one another can be effected in a simple manner. This can save both time and manpower.

(2) All of the sections can be perfectly aligned with one another without any gaps being formed. Accordingly, the artificial lawn appears, at first sight, to be made in one piece.

(3) Since the sections are made of a soft polyvinyl chloride material, it feels soft underfoot and will not be deformed, even if it is trampled upon.

(4) Since the sections are of soft PVC material, the artificial lawn can be laid over uneven ground, a feature which is not possible with conventional artificial lawn sections.

(5) The dense clusters of the artificial grass help to clean the shoes of persons walking thereon and the various drainage bores let rain and other water pass therethrough for further drainage. Accordingly, an accumulation of dirt and water does not collect on the artificial lawn and it always remains in a dry and clean condition.

(6) The clusters of artificial grass can be arranged in a style which is aesthetically pleasing.

I claim:

1. An artificial lawn section adapted for interconnection with similar lawn sections, comprising in combination a base member having first and second pairs of adjacent sides, said first pair of adjacent sides having a plurality of connecting members projecting outwardly therefrom, each connecting member having an upstanding projection member formed thereon, said base member having a plurality of throughbores formed therein, said throughbores having sets of different respective sizes, one of the sets including larger-sized bores, said throughbores being arranged in rows, wherein each row is formed with bores of the same size, a plurality of clusters of artificial grass being replaceably insertable from above into, and being non-rotatably retained in corresponding of said throughbores, and a plurality of cushioning members projecting from an underside of said base member, so as to facilitate drainage of rainwater passing to the ground through said larger-sized bores, and thereby keep the lawn-section substantially free of any water, whereby two rows of said throughbores respectively adjacent to the two sides constituting the second pair of adjacent sides fored with said larger-sized bores are capable of receiving corresponding of the upstanding projection members formed on an other lawn section below said base member, when the upstanding projection members of said other section are pushed upwardly into corresponding of said larger-sized bores formed in said base member.

2. An artificial lawn section as claimed in claim 1, wherein each of the larger sized throughbores has a cross-sectional shape corresponding substantially to that of the upstanding projection members to facilitate the insertion of the projection members and to provide retention thereof.

3. An artifical lawn section as claimed in claim 2, wherein the cross-section of each upstanding projection member is octogonal.

4. An artificial lawn section as claimed in claim 1, wherein said section is made of polyvinyl chloride material molded in an integral unit, and said material is sufficiently soft so that said section is capable of being laid over uneven ground, and of being soft on the feet of a user.

5. An artificial lawn formed from a plurality of interconnected lawn sections as claimed in claim 1.

6. An artificial lawn according to claim 1 wherein said base member is substantially square.

* * * * *